US006752586B2

(12) United States Patent
Baumann et al.

(10) Patent No.: US 6,752,586 B2
(45) Date of Patent: Jun. 22, 2004

(54) RECEPTION STATION ON A SHAPING PRESS AND A SET OF TOOLS FOR A SAID STATION

(75) Inventors: Robert Baumann, Lausanne (CH); Fabrice Calame, Villar-Ste-Croix (CH)

(73) Assignee: Bobst S.A. (CH)

( * ) Notice: Subject to any disclaimer, the term of this patent is extended or adjusted under 35 U.S.C. 154(b) by 402 days.

(21) Appl. No.: 09/853,438

(22) Filed: May 10, 2001

(65) Prior Publication Data

US 2001/0053393 A1 Dec. 20, 2001

(30) Foreign Application Priority Data

May 11, 2000 (CH) ..... 0925/00

(51) Int. Cl.[7] ..... B65H 31/32
(52) U.S. Cl. ..... 414/790.8; 271/218
(58) Field of Search ..... 271/218; 414/790.8

(56) References Cited

U.S. PATENT DOCUMENTS

| | | | | |
|---|---|---|---|---|
| 3,507,489 A | | 4/1970 | Wilshin et al. | 271/46 |
| 4,189,270 A | * | 2/1980 | Ehrlich | 271/218 |
| 4,625,956 A | | 12/1986 | Marass et al. | 271/183 |
| 4,799,847 A | * | 1/1989 | Bodewein | 414/790.8 |
| 4,995,859 A | | 2/1991 | Totani | 493/204 |
| 5,090,681 A | | 2/1992 | Henn et al. | 271/218 |
| 5,244,342 A | | 9/1993 | De Dompierre | 414/790.8 |
| 5,338,020 A | * | 8/1994 | Eltner et al. | 414/790.8 |
| 5,366,217 A | | 11/1994 | Tokuno et al. | 271/176 |
| 5,368,288 A | * | 11/1994 | Philipp et al. | 271/218 |
| 5,407,189 A | * | 4/1995 | Klenk | 414/790.8 |
| 5,669,755 A | | 9/1997 | Zahn | 414/790.1 |
| 5,749,571 A | * | 5/1998 | Heiler | 271/218 |
| 5,882,175 A | * | 3/1999 | Villacieros Fernandez | 414/790.8 |
| 6,394,443 B1 | * | 5/2002 | Vedoy et al. | 414/790.8 |
| 6,435,090 B2 | * | 8/2002 | Saito | 414/790.8 |

FOREIGN PATENT DOCUMENTS

| | | | |
|---|---|---|---|
| DE | 19824694 | 12/1999 | B65H/29/66 |
| FR | 1532130 | 6/1968 | |

* cited by examiner

*Primary Examiner*—Janice L. Krizek
(74) *Attorney, Agent, or Firm*—Ostrolenk, Faber, Gerb & Soffen, LLP

(57) ABSTRACT

A master tool for a reception station on a press for shaping sheets of paper or cardboard, comprising a moving slide and a number of bars (1) adapted to form a grid for non-stop reception of blanks and a bottom separating tool comprising two boards (4, 5) adjustable on two transverse beams (9, 10) of the moving slide, the beams having top edges having the same profile, the profile of the top edge comprising a number of serrated recesses in shape matching the cross-section of the bars (1), the serrated recesses being adjusted to correspond to the transverse positions of the openings in the bottom blank-separating tool.

15 Claims, 2 Drawing Sheets

RECEPTION STATION ON A SHAPING PRESS AND A SET OF TOOLS FOR A SAID STATION

BACKGROUND OF THE INVENTION

The invention relates to a set of tools for a reception station in a press for shaping sheets of paper or cardboard, comprising a moving slide and a number of bars constituting a grid for non-stop reception of blanks, the set of tools comprising a bottom blank-separating tool.

The invention also relates to a reception station on a press for shaping sheets of paper or cardboard, comprising a moving slide adapted to receive a number of bars for forming a grid for non-stop reception of blanks.

For each run, presses shaping sheets of paper, solid fibre board or corrugated cardboard use a set of shaping tools specific for a particular job. The typical set of tools comprises:

a make-ready sheet, a member for cutting, a top waste ejection tool, a bottom ejection board, a top blank-separating tool and a bottom blank-separating tool.

The bottom blank-separating tool can comprise a general-purpose frame adapted to receive adjustable cross-members or an internal grid made to measure and defining meshes substantially corresponding in shape to the blanks. The bottom blank-separating tool can likewise comprise a plate in which a number of openings are cut by a laser or water jet, the periphery of the openings corresponding to that of the blanks for separating. The openings in the bottom blank-separating tool are usually in a number of transverse rows disposed either exactly one behind the other with a transverse shift.

The terms "transverse" and "longitudinal" here are used with reference to the direction of advance of the sheets in the shaping press.

In order to form stable stacks of separated blanks under the tool on the reception pallet of the reception station, it is periodically necessary to insert a stabilising sheet. In order to insert the sheet without stopping the production unit, a device commonly called a "non-stop grid" is used. The device comprises a slide movable in the longitudinal direction of the press. The slide has two transverse beams on which bars can be disposed for forming a grid for non-stop reception of blanks. The bars generally have a rod-like shape. The head of the rod can engage in a recess in the beam furthest from the reception station and can be screwed therein. The rod, over a zone near the head thereof, rests on a second transverse beam of the slide, and near its other end the rod rests on a transverse roller in the immediate neighbourhood of the blank reception zone. For the purpose of insertion, the slide moves under the bottom blank-separating tool and a pair of bars holds each blank as it falls. In the case of large-area blanks, the number of bars per blank may be greater. At each instant, the non-stop grid receives the blanks, which form a stack during the insertion operations. A pre-selector defines the number of blanks per packet and/or the height of the stacks. The entire device operates automatically in known manner in accordance with a pre-programmed cycle.

The said set of tools must be very accurately positioned in the various stations of the press at the beginning of each job.

In the case of short repeated runs in particular, the productivity of the unit is closely dependent on the speed of positioning and adjustment of the tools.

In order to change rapidly from one job to another, the waste ejection tools and the top blank-separating tool are often mounted and position-marked outside the machine, on an adjustment table specially designed for this purpose. They can therefore be prepared while the machine is working on the previous job and do not slow down overall production during adjustment. On the other hand the bars forming the grid for non-stop reception of blanks must be mounted on the moving slide during a stoppage of the machine between two jobs. In known shaping presses, the operator must place each bar on the moving slide, visually align the bottom blank-separating tool disposed in the station, and transversely move the bars so as to place two or three bars in vertical alignment with each opening in the bottom blank-separating tool. The alignment is made slotwise, in an uncomfortable position for the operator. Adjustment of the position of all the bars is the most laborious operation required between jobs. If done badly, the stacks of blanks formed at the reception station will not be straight.

SUMMARY OF THE INVENTION

A first object of the invention is greatly to speed up the operation of positioning the bars constituting the grid for non-stop reception of blanks. A second object of the invention is to make the positioning more reliable and independent of the alignment capacity of the operator. A third object is to clamp and unclamp the bars quickly on the moving slide.

These objects are achieved by a set of tools comprising a master tool coupled with the bottom separating tool and comprising two boards adjustable on two transverse beams of the moving slide and with upper edges having the same profile, the said upper edge profile comprising a number of serrated recesses in shape matching the cross-section of the bars, the recesses being adjusted to correspond to the transverse positions of the openings in the bottom separating tool.

This object is also achieved by a reception station of the kind defined in the preamble, in that the moving slide comprises means for holding, retaining and centring the said master tool.

According to the invention the two boards forming the master tool are disposed on and/or against the two transverse beams of the slide. The centring means positions them transversely relative to the bottom blank-separating tool without the operator needing to make further adjustments. A bar is positioned very easily by placing the rod part in two recesses in the facing boards, thus efficiently guiding the rod and positioning it opposite the corresponding opening in the bottom blank-separating tool when the slide advances for the purpose of insertion.

The head of each bar rests against the slide beam furthest from the reception zone and can be individually screwed. Preferably the slide comprises clamping means for simultaneously fixing and clamping all the bars once adjusted on the slide by means of the master tool. The clamping means can comprise a horizontal transverse beam movable between a first position where it does not impede positioning the bars on the slide and a second position where it abuts the heads of the bars adjusted on the slide, and can also comprise a locking device for locking the moving beam in the said second position.

BRIEF DESCRIPTION OF THE DRAWINGS

Other features and advantages of the invention will be clear to the skilled man from a description of a preferred embodiment of the invention with reference to the drawings, in which.

DETAILED DESCRIPTION OF THE INVENTION

Figure 1:
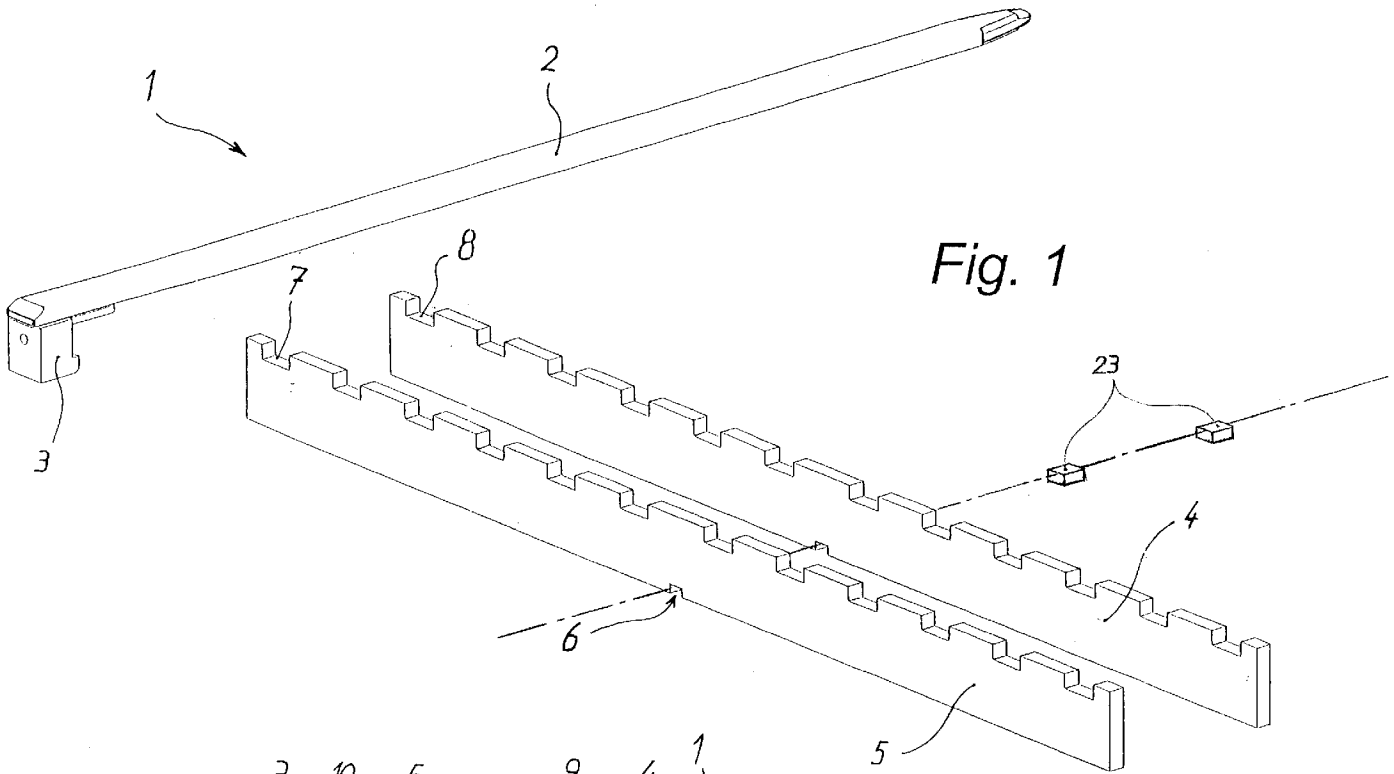
FIG. 1 is a perspective view of a master tool and a bar in positions spaced apart from one another.

FIG. 1, top left, shows a bar 1 for non-stop reception of blanks and comprising a head 3 and a rod 2 having a square cross-section. Two boards 4, 5 having a generally rectangular elongate shape are disposed below the bar 1 and constitute the master tool. On their bottom edges, the boards 4 and 5 have a centring notch 6 for accurately positioning them in the machine by placing the notches on a matching centring block 23 stud pin or the like. The boards 4, 5 have a number of serrated recesses on their top edges, the shape of each recess 7, 8 corresponding exactly to the cross-section of the rod part 2 of the bar 1. The recesses 7, 8 are disposed on the boards 4, 5 so that if the bottom blank-separating tool is placed in the machine and if the boards are placed on a slide 21 (See FIG. 2) and centred, each opening in a transverse row, viewed longitudinally, is opposite at least two adjacent recesses on the two boards, or three if required, if justified by the width of the opening in the bottom blank-separating tool. The recess in the top edges of the boards 4, 5 can be made easily and very accurately by the member producer, since his CAD data contain all details of the bottom blank-separating tool. These details perfectly determine the respective position and the spacing between the bars. The serrated recesses can be cut by a laser with an accuracy of two-tenths of a millimeter.

Figure 2:
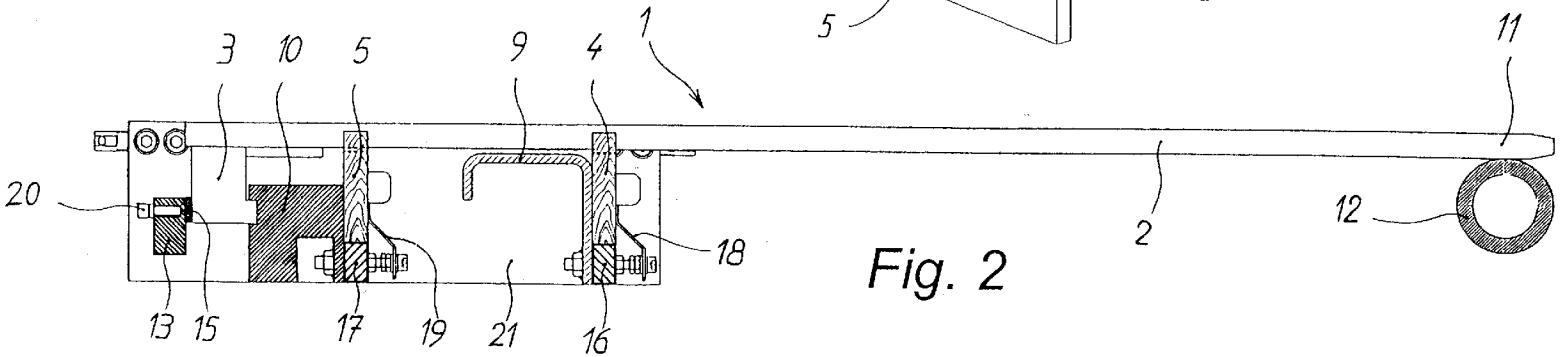
FIG. 2 is a diagrammatic view in longitudinal section of the moving slide with a bar in position.

FIG. 2 is a view in section of the boards 4, 5 positioned on the cross-beams 9, 10 of the moving slide 21. The beams 9, 10 have two attached shoulders 16, 17 and two spring strips 18, 19 for holding and retaining the boards 4 and 5. The centring notches 6 in the boards engage on projecting centring blocks (not shown) on the beams 9 and 10. As shown in FIG. 2, the height of the boards 4, 5 is adjusted so that the bottoms of the recesses 7, 8 touch or are slightly below the top surfaces of the beams 9, 10. When the boards 4, 5 are positioned on the beams 9 and 10, the spacing between them is of the order of 150 mm.

A stud on the head 3 of the bar 1 engages in a matching recess in the bar 10. The opposite end 11 of the rod 2 rests on a transverse roller 12 situated in the immediate neighbourhood of the blank reception zone. In view of the accuracy with which the two boards 4 and 5 are machined, the end 11 of the rod 2 is sufficiently accurately positioned under an opening in the bottom blank-separating tool.

When all the bars 1 are placed on the moving slide 21, a transverse beam 13, either movable or adapted to be brought into a position where it does not impede positioning of the bars, presses on the set of heads 3 of the bars 1. The moving beam 13 has a rubber lining 15 so as to even out the force with which it bears against each bar 1. The moving beam 13 can be locked in the bearing position by one or more lever locking systems known per se and diagrammatically indicated by reference 20 in FIG. 2.

The bars 1 constituting the non-stop reception grid are thus clamped or unclamped in a single and very rapid operation, during which the bars are held in the correct position by the master tool.

Figure 3:
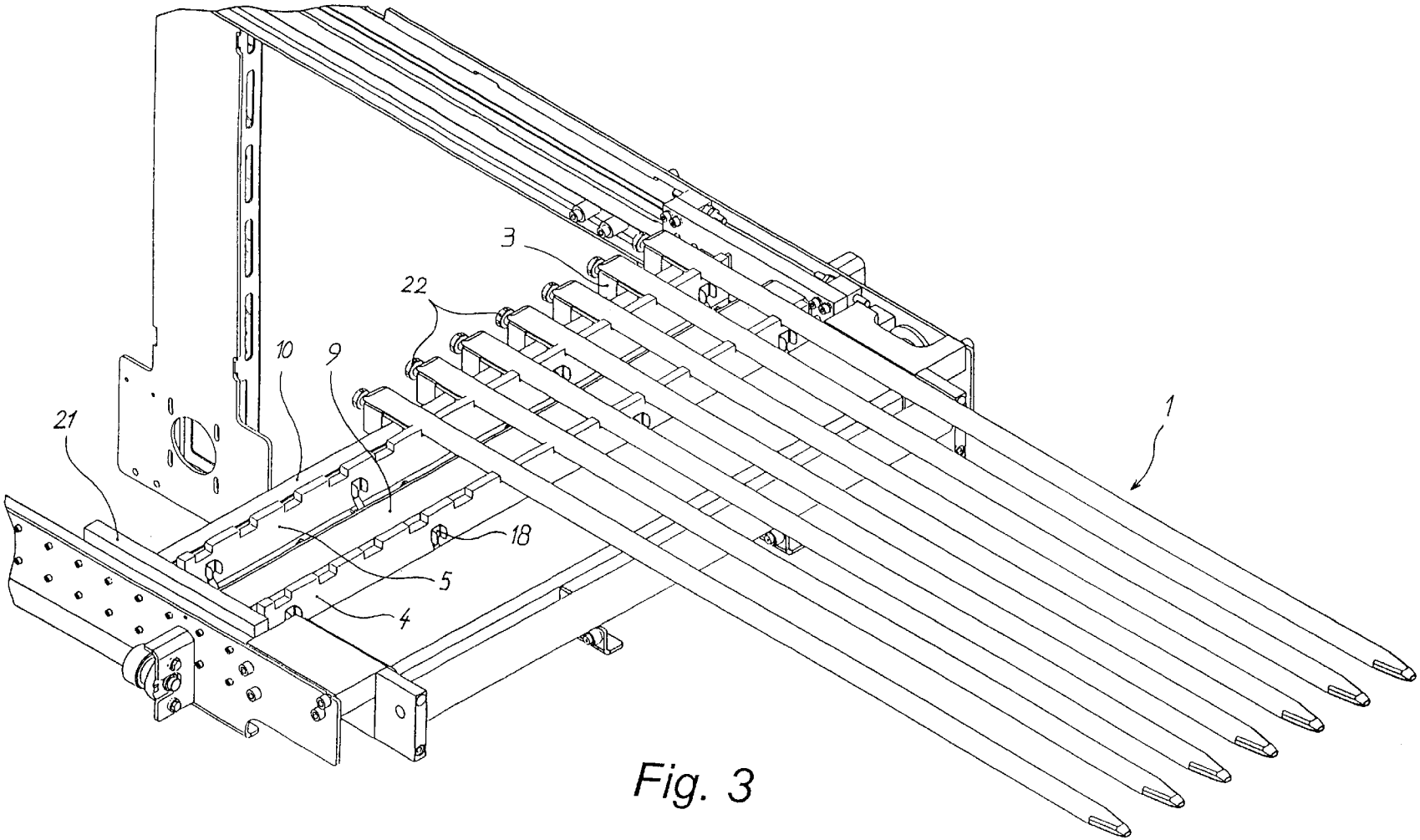
FIG. 3 is a diagrammatic perspective view of the top of the moving slide comprising individually fixed bars.

FIG. 3 is a diagrammatic perspective view of the top of the moving chariot 21 with the bars 1 fixed individually. In this embodiment, each bar 1 is locked in position by threaded screws 22 which clamp the heads 3 against the beam 10.

What is claimed is:

1. A set of tools for a reception station in a press for shaping sheets of paper or cardboard, comprising a moving slide (21) and a number of bars (1) constituting a grid for non-stop reception of blanks, the set of tools comprising: a bottom blank-separating tool having openings in transverse positions; and a master tool coupled with the bottom blank-separating tool, the master tool comprising two boards (4, 5) adjustable on two transverse beams (9, 10) of the moving slide, the boards (4, 5) having upper edges having the same upper edge profile, the upper edge profile comprising a number of serrated recesses (7, 8) in the shape matching the cross-section of the bars (1), the recesses (7, 8) being adjusted to correspond to the transverse positions of the openings in the bottom blank-separating tool.

2. A set of tools according to claim 1, characterised in that each board (4, 5) has a centring notch (6) co-operating with a centring block on a beam (9, 10) of the moving slide (21).

3. A set of tools according to claim 1, characterised in that each board (4, 5) has a centring block co-operating with a centring notch in a beam (9, 10) of the moving slide (21).

4. A reception station on a press for shaping sheets of paper or cardboard, comprising a moving slide (21) adapted to receive a number of bars (1) for forming a grid for non-stop reception of blanks, characterized in that the moving slide (21) comprises means (16, 17, 18, 19) for holding, retaining and centring a master tools, the master tool being coupled with a bottom blank-separating tool, the master tool comprising two boards (4, 5) adjustable on two transverse beams (9, 10) of the moving slide, the boards (4, 5) having upper edges having the same upper edge profile, the upper edge profile comprising a number of serrated recesses (7, 8) in the shape matching the cross-section of the bars (1), the recesses (7, 8) being adjusted to correspond to the transverse positions of the openings in the bottom blank-separating tool.

5. A station according to claim 4, characterised in that the moving slide (21) comprises clamping means for fixing and simultaneously holding the set of bars (1) adjusted on the transverse beams (9, 10).

6. A station according to claim 5, characterised in that the clamping means comprise a horizontal transverse beam (13) movable between a first position in which it does not impede positioning of the bars on the transverse beams (9, 10) and a second position in which it abuts heads (3) of the bars (1) adjusted on the transverse beams (9, 10), and also comprises a locking device (20) for locking the transverse beam (13) in the second position.

7. A station according to claim 6, characterized in that the transverse beam (13) has a lining of rubber (15) on the surface in contact with the heads (3) of the bars (1).

8. A reception station on a press for shaping sheets of paper or cardboard, comprising a moving slide (21) adapted to receive a number of bars (1) for forming a grid for non-stop reception of blanks, characterized in that the moving slide (21) comprises means (16, 17, 18, 19) for holding, retaining and centring a master tools, the master tool being coupled with a bottom blank-separating tool, the master tool comprising two boards (4, 5) adjustable on two transverse beams (9, 10) of the moving slide, the boards (4, 5) having upper edges having the same upper edge profile, the upper edge profile comprising a number of serrated recesses (7, 8) in the shape matching the cross-section of the bars (1), the recesses (7, 8) being adjusted to correspond to the transverse positions of the openings in the bottom blank-separating tool, each board (4, 5) having a centring notch (6) co-operating with a centring block on a beam (9, 10) of the moving slide (21).

9. A station according to claim 8, characterized in that the moving slide (21) comprises clamping means for fixing and simultaneously holding the set of bars (1) adjusted on the transverse beams (9, 10).

10. A station according to claim 9, characterized in that the clamping means comprise a horizontal transverse beam (13) movable between a first position in which it does not impede positioning of the bars on the transverse beams (9, 10) and a second position in which it abuts the heads (3) of the bars (1) adjusted on the transverse beams (9, 10), and also comprise a locking device (20) for locking the transverse beam (13) in the second position.

11. A station according to claim 10, characterized in that the transverse beam (13) has a lining of rubber (15) on the surface in contact with the heads (3) of the bars (1).

12. A reception station on a press for shaping sheets of paper or cardboard, comprising a moving slide (21) adapted to receive a number of bars (1) for forming a grid for non-stop reception of blanks, characterized in that the moving slide (21) comprises means (16, 17, 18, 19) for holding, retaining and centring a master tools, the master tool being coupled with a bottom blank-separating tool, the master tool comprising two boards (4, 5) adjustable on two transverse beams (9, 10) of the moving slide, the boards (4, 5) having upper edges having the same upper edge profile, the upper edge profile comprising a number of serrated recesses (7, 8) in the shape matching the cross-section of the bars (1), the recesses (7, 8) being adjusted to correspond to the transverse positions of the openings in the bottom blank-separating tool, each board (4, 5) having a centring block co-operating with a centring notch in a beam (9, 10) of the moving slide (21).

13. A station according to claim 12, characterized in that the moving slide (21) comprises clamping means for fixing and simultaneously holding the set of bars (1) adjusted on the transverse beams (9, 10).

14. A station according to claim 13, characterized in that the clamping means comprise a horizontal transverse beam (13) movable between a first position in which it does not impede positioning of the bars on the transverse beams (9, 10) and a second position where in which it abuts the heads (3) of the bars (1) adjusted on the transverse beams (9, 10), and also comprise a locking device (20) for locking the transverse beam (13) in the second position.

15. A station according to claim 14, characterized in that the transverse beam (13) has a lining of rubber (15) on the surface in contact with the heads (3) of the bars (1).

* * * * *